US005791112A

United States Patent [19]

Plum

[11] Patent Number: 5,791,112

[45] Date of Patent: Aug. 11, 1998

[54] ROOF SLATE ARRANGEMENTS

[76] Inventor: Horst Peter Plum, 47 Viben Avenue, Brackenfell 7560, South Africa

[21] Appl. No.: 605,443

[22] Filed: Feb. 26, 1996

[30] Foreign Application Priority Data

Feb. 28, 1995 [ZA] South Africa ..... 95/1630

[51] Int. Cl.[6] ..... E04D 1/12

[52] U.S. Cl. ..... 52/551; 52/543; 52/553

[58] Field of Search ..... 52/549, 551, 552, 52/553, 543, 521

[56] References Cited

U.S. PATENT DOCUMENTS

| | | | |
|---|---|---|---|
| 1,102,680 | 7/1914 | Overbury | 52/543 |
| 1,638,666 | 8/1927 | Shuman | 52/549 |
| 2,116,452 | 5/1938 | Shipway | 52/553 |
| 2,143,166 | 1/1939 | Pattiani | 52/553 |
| 2,727,283 | 12/1955 | Gollner | 52/553 |
| 2,820,257 | 1/1958 | Newton | 52/553 |
| 3,440,777 | 4/1969 | Martin | 52/551 |
| 5,457,924 | 10/1995 | Fujii et al. | 52/553 |

FOREIGN PATENT DOCUMENTS

| | | | |
|---|---|---|---|
| 612763 | 10/1926 | France | 52/549 |
| 918693 | 2/1947 | France | 52/552 |
| 2603209 | 8/1977 | Germany | 52/551 |
| 408447 | 4/1934 | United Kingdom | 52/552 |

*Primary Examiner*—Michael Safavi
*Attorney, Agent, or Firm*—Larson & Taylor

[57] ABSTRACT

A roof arrangement includes a plurality of spaced apart substantially parallel adjacent battens arranged on increasing higher levels and a plurality of rows of roof slates supported on the battens. Each row of roof slates comprises a plurality of adjacently arranged slates with a gap being defined between two adjacent slates. Adjacent rows of slates are off-set. A support strip is located below the gap between two adjacent slates and extends laterally beyond the gap to a location underneath the two slates defining the gap, and further extends from one batten to a next higher batten. A waterproof strip extends below a row of slates from close to the lower end of the slates of the row of slates and is bent over the upper end of the slates of the row of slates to rest on to the upper end of the row of slates. First attachment elements pass through each slate near its upper end and through the waterproof strip below the slate into a batten located below the slate. Second attachment elements pass through each slate near the bottom thereof and through the support strip below the slate.

5 Claims, 8 Drawing Sheets

ROOF SLATE ARRANGEMENTS

FIELD OF INVENTION

The present invention relates to roof slate arrangements.

BACKGROUND TO INVENTION

There are various roof slate arrangements comprising components and attachment means for attaching roof slates on a roof frame structure. These slates conventionally are arranged in rows in overlap fashion and are nailed to the supporting battens. Suitable waterproof soaker material sheets are provided below the slates for keeping out moisture.

It is an object of the invention to suggest a new roof slate arrangement.

SUMMARY OF INVENTION

In accordance with the invention a roof arrangement is provided which includes:

a. a plurality of spaced apart substantially parallel adjacent battens arranged on increasing higher levels;

b. a plurality of rows of roof slates supported on the battens, each slate having a lower end and an upper end;

C. each row of roof slates comprising a plurality of adjacently arranged slates, a gap being defined between two adjacent slates;

d. the slates of one row of slates being off-set relative to the slates of an adjacent next row of slates;

e. a support strip located below the gap between two adjacent slates and extending laterally beyond the gap to a location underneath the two slates defining the gap, and further extending from one batten to a next higher batten;

f. a waterproof strip extending below a row of slates from close to the lower end of the slates of said row of slates and being bent over the upper end of the slates of said row of slates to rest on to the upper end of the said row of slates;

g. first attachment means passing through each slate near its upper end and through the waterproof strip below the slate into a batten located below the slate; and h. second attachment means passing through each slate near its lower end and through the support strip located below said slate.

Preferably, the first attachment means comprises two clout nails passing through each slate at the upper end thereof, by-passing a support strip therebelow and extending into the batten located below the corresponding slate.

In one embodiment, the second attachment means comprises a rivet.

In another embodiment, the second attachment means comprises a screw.

Advantageously, the waterproof strip comprises bitumen felt material.

BRIEF DESCRIPTION OF DRAWINGS

The invention will now be described by way of example with reference to the accompanying schematic drawings.

In the drawings there is shown in.

DETAILED DESCRIPTION OF DRAWINGS

Referring to FIGS. 1, 5, 7 and 9 a side view of a roof structure provided with roof slates on battens is shown. The slates are arranged in conventional manner so that they overlap, the overlapping layer of slates being offset relative to the previous layer, etc.

As is shown in FIGS. 1, 5, 7 and 9 a rafter 10 supports parallel arranged battens 12.1, etc on which roof slates 14.1, 14.2, 14.3, 14.4 etc. are attached.

Figure 4:
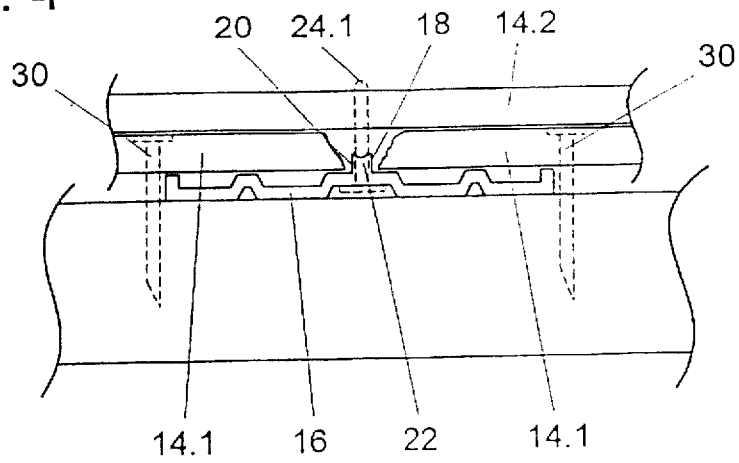
FIG. 4 a view corresponding to FIG. 3 but showing two adjacent slates placed on a support strip and a superimposed slate placed thereon.

As is particularly shown in FIG. 4, in conventional manner the slates 14.1 of the lower row are placed next to each other and the slates 14.2 of the superimposed or next upper row are offset relative to the lower row.

Below the slates 14.1 and the gap formed between them a support strip 16 is provided. This support strip 16 is of corrugated shape as shown. It has a hole 18 formed in a reinforcement tube 20 having a projecting part 22 through which a rivet 24.1 is passed, the rivet 24.1 also passing between slate 14.1 and through the slate 14.2.

The support strip 16 protects the soaker or waterproof felt strip 26, it holds the rivet 24.1, in position, and at the lower end protects the upper end of the lower slates.

The strip 26 may be made of bitumen, plastics or any other suitable material.

The support 16 also leads water away from the soaker or waterproof felt strip 26.

The comers of the strip 16 may be slightly rounded.

The soaker or waterproof strip 26 extends below the slate 14.3 and at the upper end is bent over at 28 to fit over that end.

In FIG. 4 it is shown that the clout nails 30 pass through the slate 14.1 but bypass the support strip 16.

The slate 14.1 is attached to the batten 12.1 respectively by means of two clout nails 30.1 whereas the slate 14.2 is attached by means of two clout nails 30.2 to the batten 12.2 etc.

Figure 1:
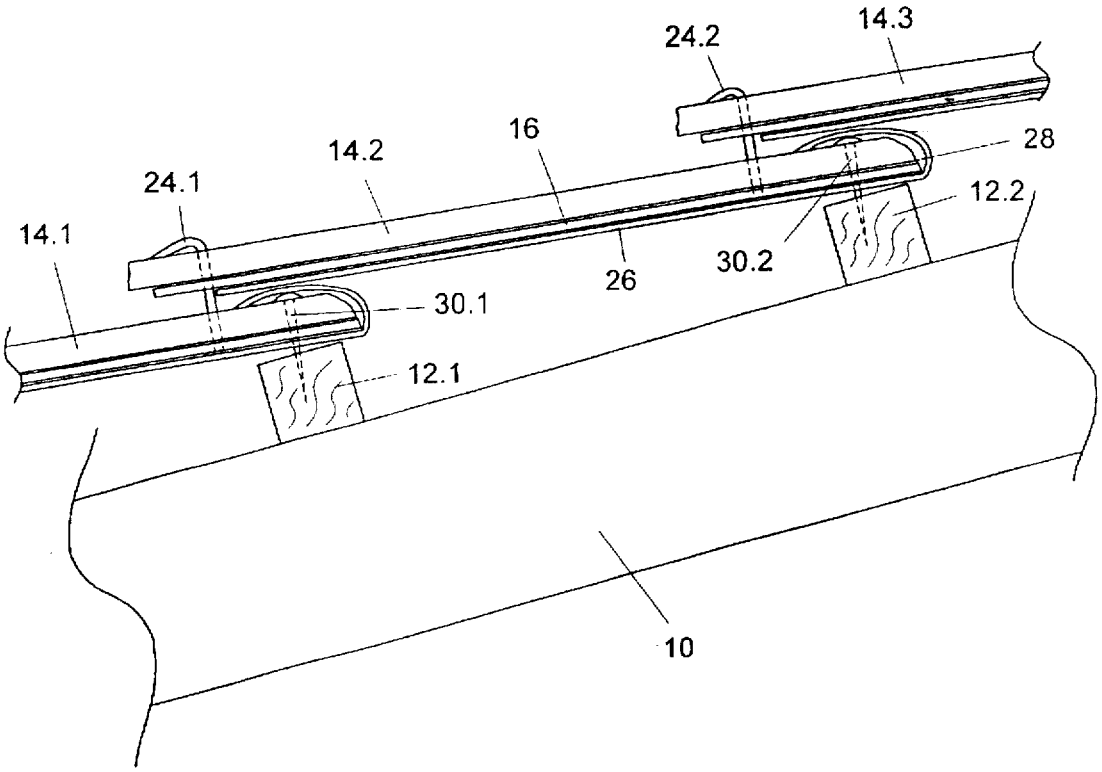
FIG. 1 A side view of three overlapping slates provided with a support strip of a roof slate arrangement in accordance with a first embodiment of the invention.
Figure 2:
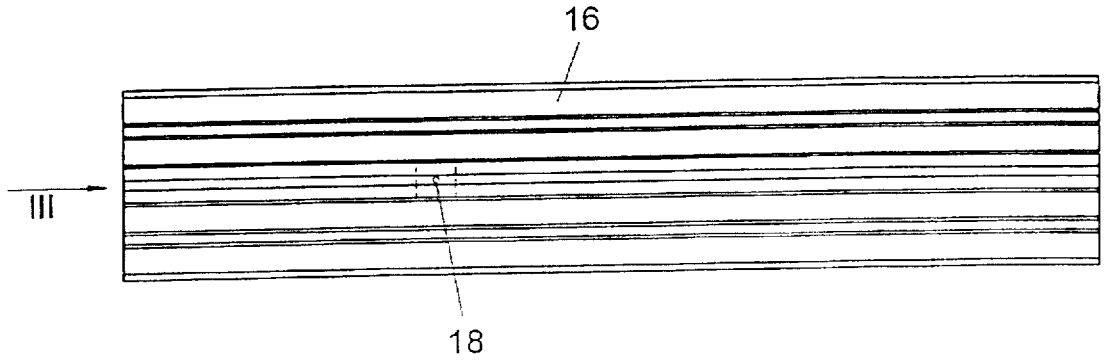
FIG. 2 on a reduced scale a plan view of a support strip in accordance with the invention and as illustrated in FIG. 1.
Figure 3:
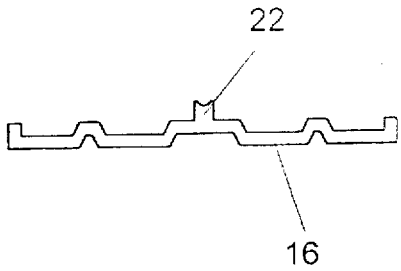
FIG. 3 on an increased scale an end view of the support strip seen along arrow III in FIG. 2.
Figure 5:
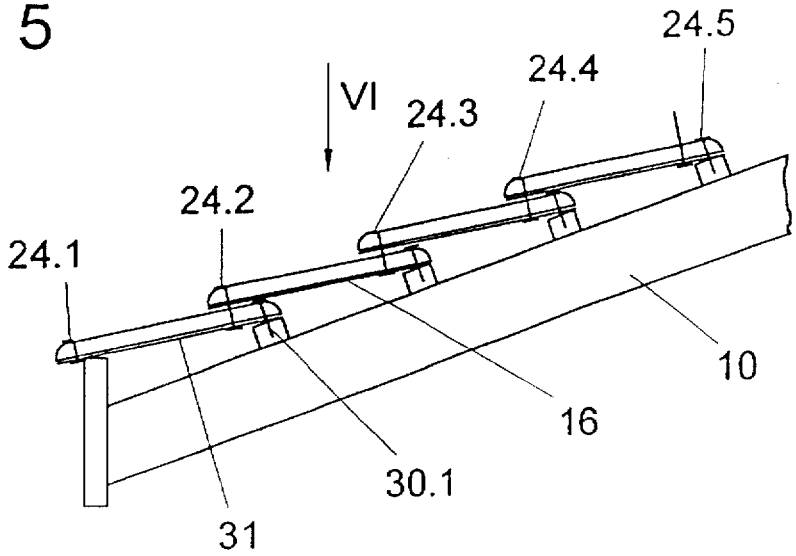
FIG. 5 on a reduced scale a side view of a number of slates held in position on battens on a roof structure.
Figure 6:
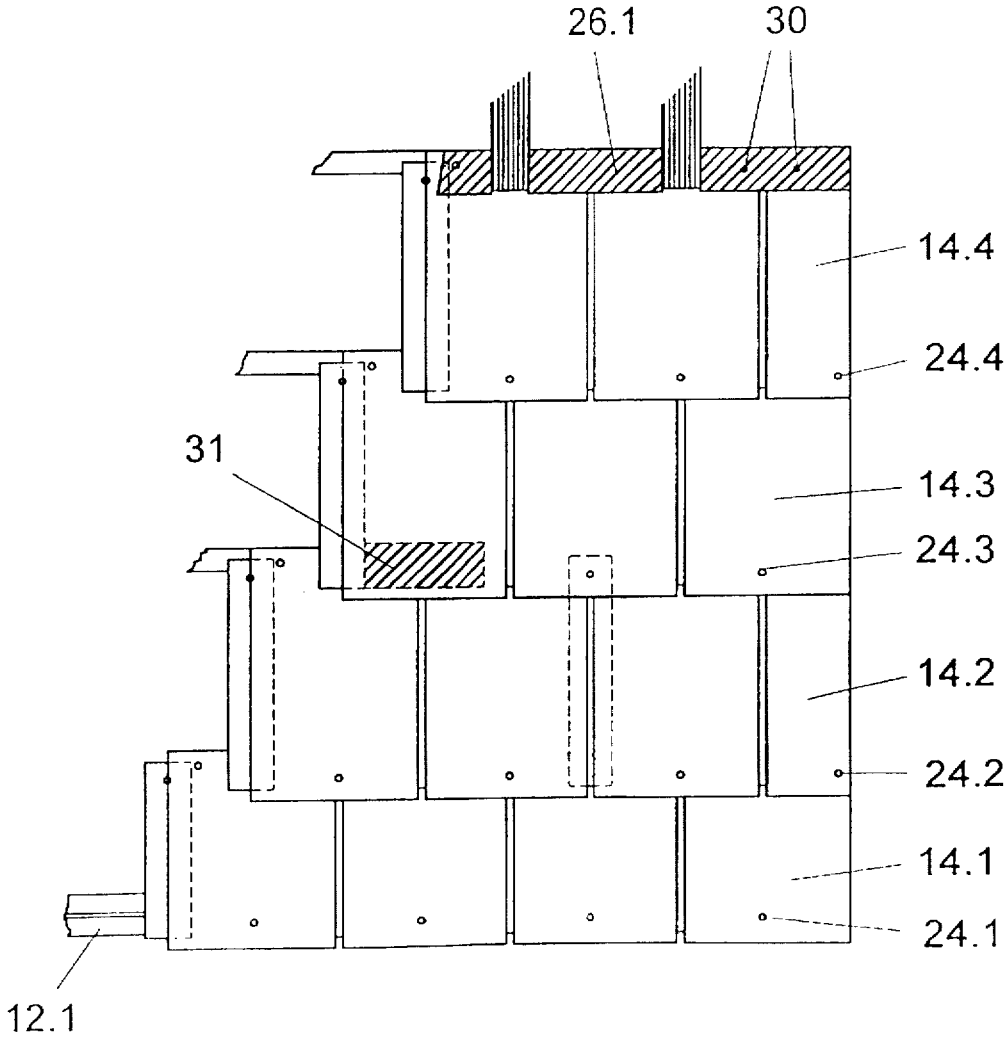
FIG. 6 a plan view seen along arrow VI in FIG. 5 showing filler pieces or washers.

Referring to FIGS. 5 and 6 a pitched roof is shown in which a filler piece or washer 31 is provided with a waterproof felt strip 26.1 and otherwise being similar to the arrangement shown in FIG. 1.

Figure 7:
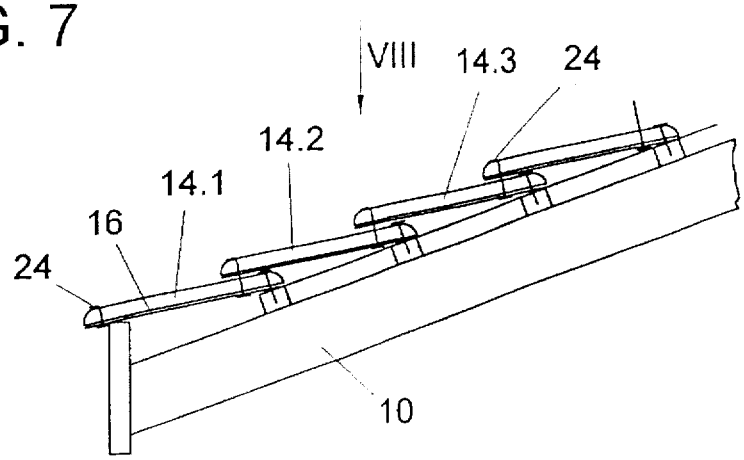
FIG. 7 a view corresponding to FIG. 1 but showing a double layer of soaker material not bent over.
Figure 8:
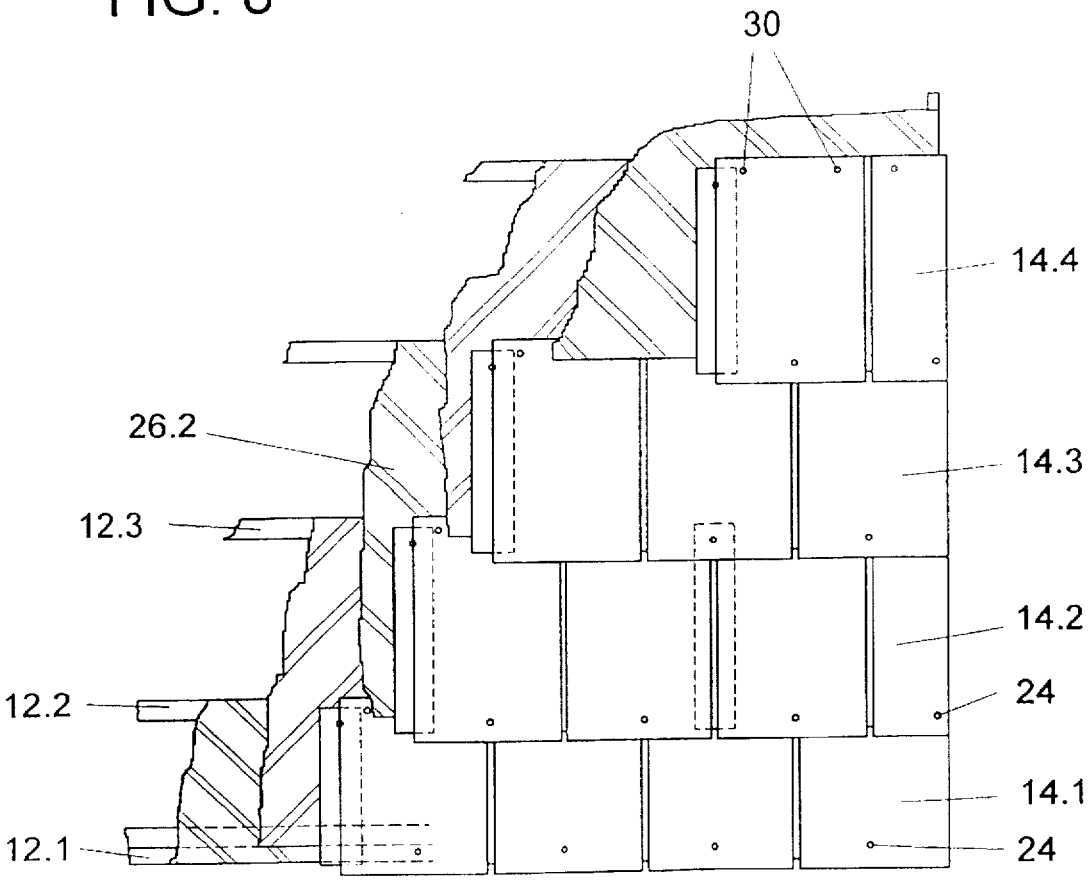
FIG. 8 a plan view seen along arrow VIII in FIG. 7.

In FIGS. 7 and 8 a double layer of felt 26.2, etc is provided, this extending along below two horizontal layers of slates as shown, e.g. layers 14.3 and 14.4.

Figure 9:
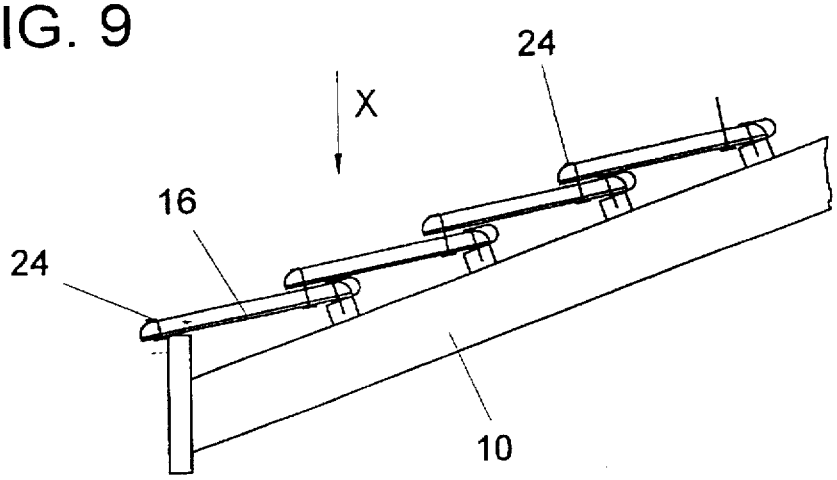
FIG. 9 a view corresponding to FIG. 1 but showing a single layer of soaker bent over.
Figure 10:
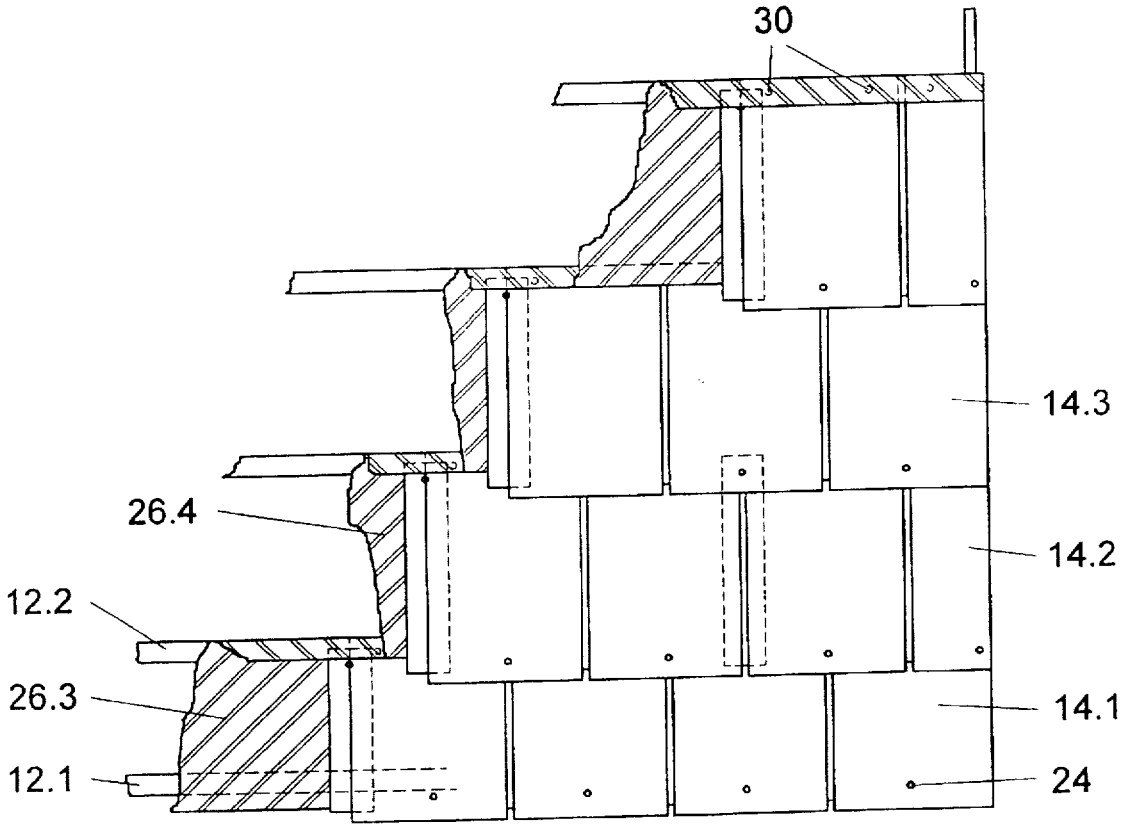
FIG. 10 a plan view seen along arrow X in FIG. 9.
Figure 16:
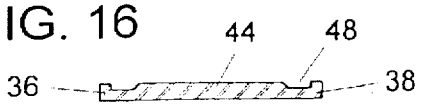
FIG. 16 a sectional view seen along arrows XVI—XVI in FIG. 12.
Figure 11:
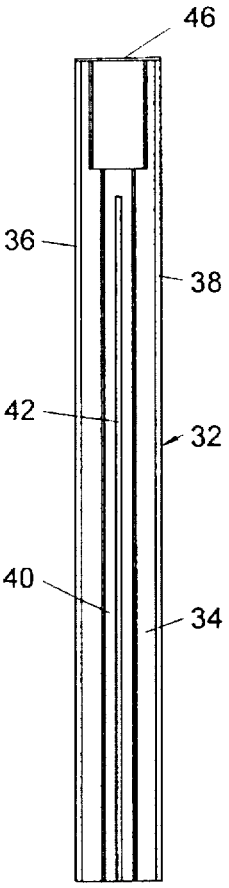
FIG. 11 a plan view of a second embodiment of a support strip in accordance with the invention.

FIGS. 9 and 10 show a bent over waterproof layer 26.3, 26.4 etc.

Referring to FIGS. 11 to 16, another embodiment of a support strip, in accordance with the invention, generally indicated by reference numeral 32, is shown. It is of longitudinal shape including a panel 34 along the edges of which upwardly directed ridges 36, 38 are provided and in the centre of which a raised part 40 with a ridge 42 are formed.

Figure 15:
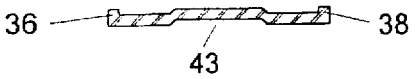
FIG. 15 a sectional end view seen along arrow XV—XV in FIG. 12.
Figure 14:
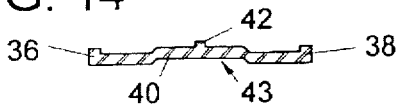
FIG. 14 a sectional side view seen along arrow XIV—XIV in FIG. 12.
Figure 12:
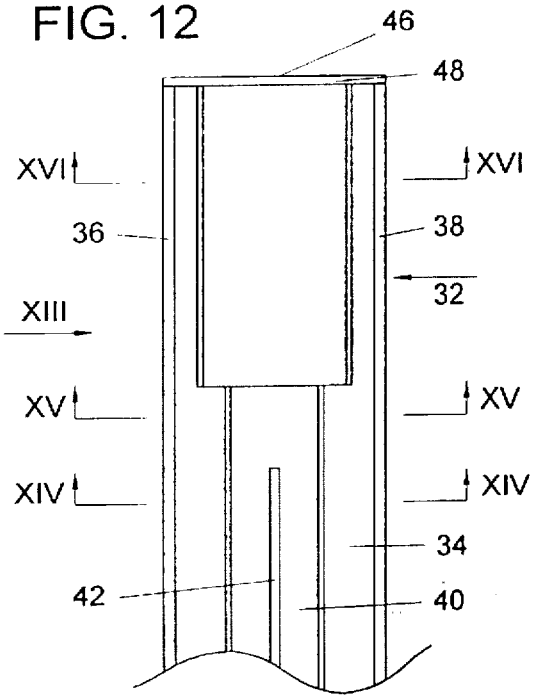
FIG. 12 an enlarged view of the top end part of the support strip illustrated in FIG. 11.
Figure 13:
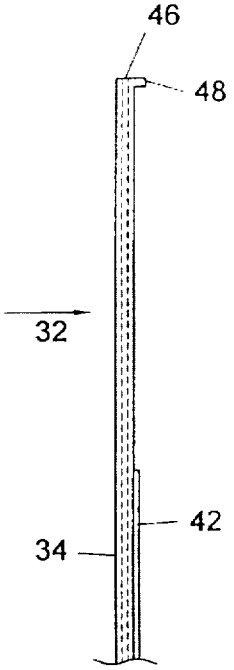
FIG. 13 a side view seen along arrow XIII in FIG. 12.

As can be seen in FIGS. 14 and 15 a space 43 is defined below the raised part 40.

At the one end of the strip 32 a solid part 44 is provided below which no space or recess 43 is defined. At the bottom end 46 of the strip 32 a transverse ridge 48 is defined.

Figure 17:
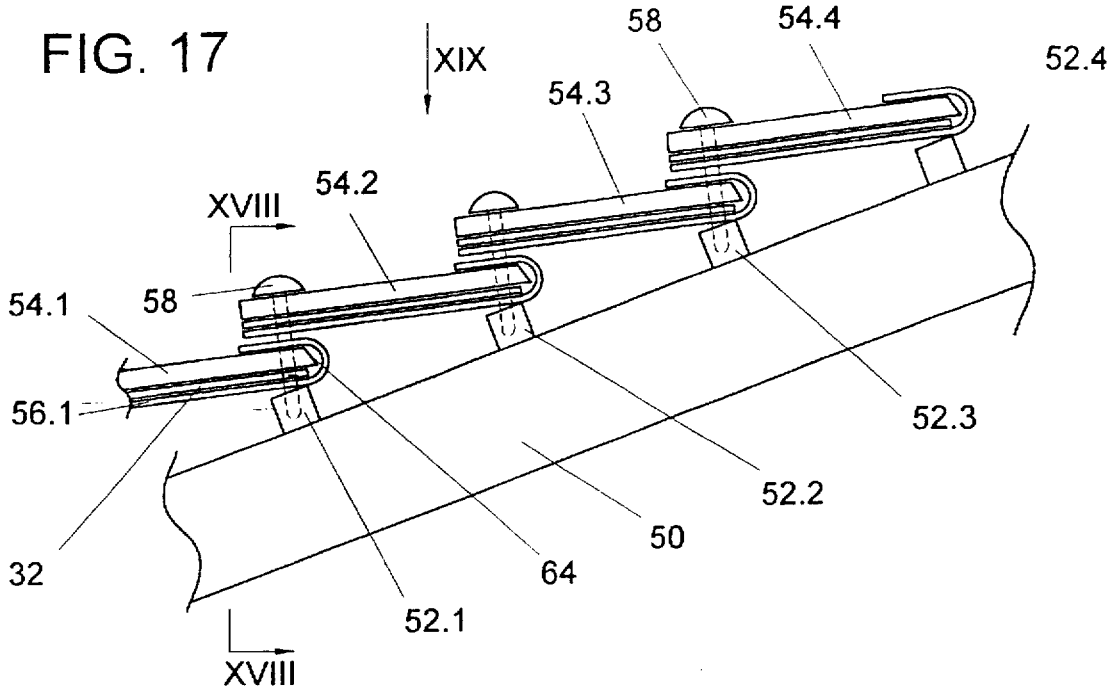
FIG. 17 a side view of a number of slates held in position on battens on a roof structure using the support strips as illustrated in FIG. 11 to 16 of a roof slate arrangement in accordance with a second embodiment of the invention.
Figure 18:
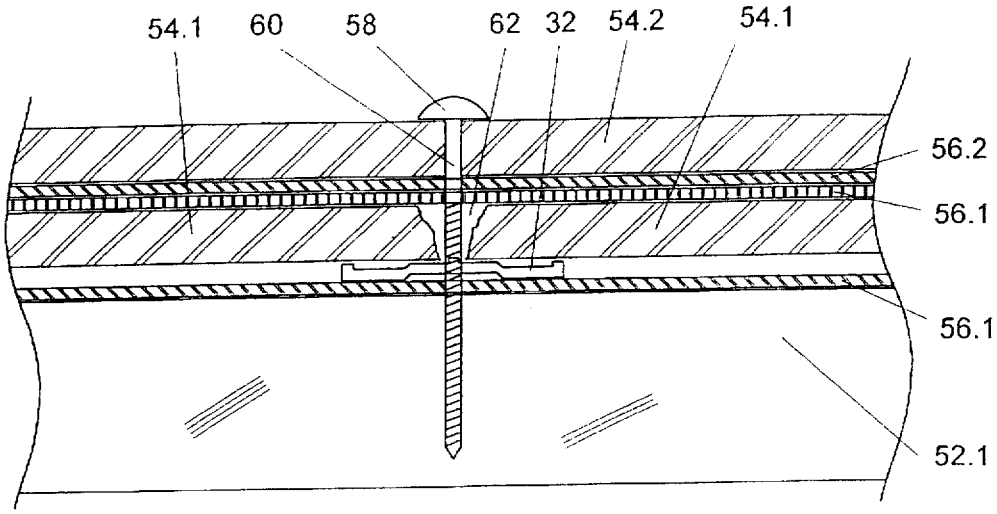
FIG. 18 on an enlarged scale and seen along arrows XVIII—XVIII in FIG. 17 a detail of the fastening of slates to a batten.
Figure 19:
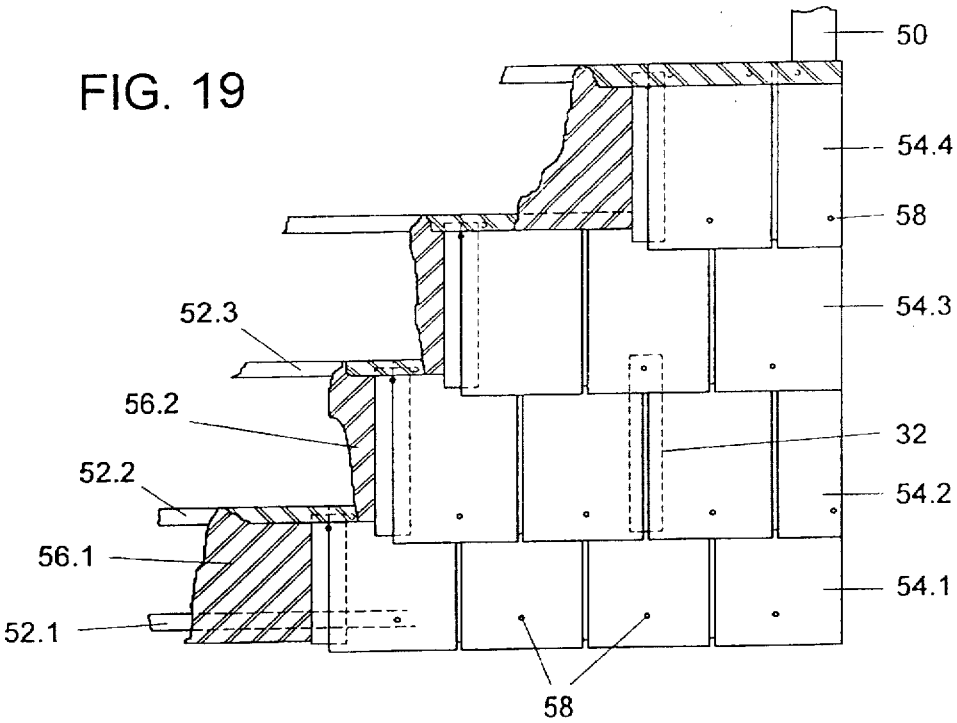
FIG. 19 a plan view seen along arrow XIX in FIG. 17.

Referring to FIGS. 17 to 19 a side view of a roof structure provided with roof slates on battens is shown. As in the case of the illustration in FIG. 1, the slates are arranged in conventional manner so that they overlap, each overlapping layer of slates being offset relative to the previous layer, etc.

A rafter 50 supports parallel arranged battens 52.1, 52.2, 52.3, etc. on which roof slates 54.1, 54.2, 54.3, 54.4 etc. are attached.

In conventional manner, the slates 54.1 of the lower row are placed next to each other and the slates 54.2 of the super-imposed or next row are offset relative to the slates 54.1 of the lower row.

Below the adjacent slates 54.1 a support strip 32 as illustrated in FIGS. 11 to 16 is provided.

The support strip 32 protects the waterproof felt strip 56.1, it holds a screw 58 passing through a pre-drilled hole 60 in the slate 54.2 in position and through the gap 62, formed between the adjacent lower slates 54.1, into the batten 52.1.

The support strip 32 also leads water away from the waterproof felt strip 56.1. The soaker or waterproof strip 56.1 extends below the slate 54.1 and at the upper end is bent over at the upper end 64 of its row of slates to fit over that end below the lower end of the next row of slates 54.2.

Therefore, as shown in the embodiments of FIGS. 11 to 20 a single screw 58 is used to fix each slate.

The support strip 32 may be made of any suitable material such as metal or plastics.

I claim:

1. A roof arrangement comprising:

a. a plurality of spaced apart substantially parallel adjacent battens arranged on increasing higher levels;

b. a plurality of rows of roof slates supported on the battens, each slate having a lower end and an upper end;

c. each row of roof slates comprising a plurality of adjacently arranged slates, a gap being defined between two adjacent slates;

d. the slates of one row of slates being off-set relative to the slates of an adjacent next row of slates;

e. a support strip located below the gap between two adjacent slates and extending laterally beyond the gap to a location underneath the two slates defining the gap, and further extending from one batten to a next higher batten;

f. a waterproof strip extending below a row of slates from close to the lower end of the slates of said row of slates and being bent over the upper end of the slates of said row of slates to rest on to the upper end of the said row of slates;

g. first attachment means passing through each slate near its upper end and through the waterproof strip below the slate into a batten located below the slate; and h. second attachment means passing through each slate near its lower end and through the support strip located below said slate.

2. An arrangement as claimed in claim 1, in which the first attachment means comprises two clout nails passing through each slate at the upper end thereof, by-passing a support strip therebelow and extending into the batten located below the corresponding slate.

3. An arrangement as claimed in claim 1, in which the second attachment means comprises a rivet.

4. An arrangement as claimed in claim 1, in which the second attachment means comprises a screw.

5. An arrangement as claimed in claim 1, in which the waterproof strip comprises bitumen felt material.

* * * * *